US011002499B2

(12) United States Patent
Chen et al.

(10) Patent No.: US 11,002,499 B2
(45) Date of Patent: May 11, 2021

(54) WATER DISTRIBUTION SYSTEM WITH WIDE-RANGE VARIABLE TRAFFIC

(71) Applicant: SHANGHAI ACE COOLING REFRIGERATION TECHNOLOGY CO., LTD., Shanghai (CN)

(72) Inventors: Yongsheng Chen, Shanghai (CN); Jing Zeng, Shanghai (CN); Feng Li, Shanghai (CN)

(73) Assignee: SHANGHAI ACE COOLING REFRIGERATION TECHNOLOGY CO., LTD., Shanghai (CN)

( * ) Notice: Subject to any disclaimer, the term of this patent is extended or adjusted under 35 U.S.C. 154(b) by 302 days.

(21) Appl. No.: 16/066,954

(22) PCT Filed: Dec. 21, 2016

(86) PCT No.: PCT/CN2016/111316
§ 371 (c)(1),
(2) Date: Nov. 30, 2018

(87) PCT Pub. No.: WO2017/114259
PCT Pub. Date: Jul. 6, 2017

(65) Prior Publication Data

US 2019/0120575 A1 Apr. 25, 2019

(30) Foreign Application Priority Data

Dec. 28, 2015 (CN) ..... 201511003733.1

(51) Int. Cl.
*F28F 25/06* (2006.01)
*F28F 25/02* (2006.01)
(Continued)

(52) U.S. Cl.
CPC ..... *F28F 25/06* (2013.01); *B05B 1/341* (2013.01); *B05B 1/3436* (2013.01); *F28C 1/06* (2013.01);
(Continued)

(58) Field of Classification Search
CPC . F28F 25/06; F28F 25/04; F28F 25/02; B05B 1/341; B05B 1/3436; B05B 1/265; F28C 1/06
See application file for complete search history.

(56) References Cited

U.S. PATENT DOCUMENTS 1,674,480 A 6/1928 Bernard
1,877,046 A 9/1932 Phillips
(Continued)

FOREIGN PATENT DOCUMENTS

CN 2143759 Y 10/1993
CN 2212181 Y 11/1995
(Continued)

OTHER PUBLICATIONS

EPO translation of CN104864743 (Year: 2015).*
(Continued)

*Primary Examiner* — Stephen Hobson
(74) *Attorney, Agent, or Firm* — Honigman LLP; Matthew H. Szalach; Jonathan P. O'Brien

(57) ABSTRACT

A water distribution system with wide-range variable traffic includes a water distribution tank and at least two types of spray heads uniformly distributed on the bottom of the water distribution tank. Each spray head is provided with a spray pipe connected to the bottom of the water distribution tank. A water inlet is arranged on the upper part of each spray pipe, and a water outlet is arranged on the lower part of the spray pipe. The heights, by which water inlets of at least two
(Continued)

types of spray heads are exposed out of the bottom of the water distribution tank, are different.

18 Claims, 6 Drawing Sheets

(51) Int. Cl.
*B05B 1/34* (2006.01)
*F28C 1/06* (2006.01)
*F28F 25/04* (2006.01)
*B05B 1/26* (2006.01)

(52) U.S. Cl.
CPC ..... *F28F 25/02* (2013.01); *F28F 25/04* (2013.01); *B05B 1/265* (2013.01)

(56) References Cited

U.S. PATENT DOCUMENTS

| | | | | |
|---|---|---|---|---|
| 2,005,600 | A | 6/1935 | Alexander | |
| 2,375,528 | A | 5/1945 | De Flon | |
| 3,061,204 | A * | 10/1962 | MacInnes | B05B 1/265 239/500 |
| 4,350,302 | A * | 9/1982 | Gruber | B05B 1/265 239/500 |
| 4,700,893 | A | 10/1987 | Bugler, III | |
| 5,180,103 | A | 1/1993 | Harrison, Jr. et al. | |
| 6,360,970 | B1 | 3/2002 | Fitzgerald | |
| 2012/0241541 | A1* | 9/2012 | Ning | B05B 1/00 239/589 |
| 2015/0115066 | A1* | 4/2015 | Drechsel | A01G 25/02 239/518 |
| 2015/0176908 | A1* | 6/2015 | Rosenwach | F28F 25/02 261/109 |
| 2018/0311684 | A1* | 11/2018 | Lawyer | B05B 3/0486 |
| 2018/0361181 | A1* | 12/2018 | Huotari | B05B 1/265 |
| 2019/0015849 | A1* | 1/2019 | Geerligs | B05B 3/003 |
| 2019/0113293 | A1* | 4/2019 | Chen | F28F 25/06 |

FOREIGN PATENT DOCUMENTS

| | | | |
|---|---|---|---|
| CN | 201011486 | Y | 1/2008 |
| CN | 201335649 | Y | 10/2009 |
| CN | 101738097 | A | 6/2010 |
| CN | 201607160 | U | 10/2010 |
| CN | 202734658 | U | 2/2013 |
| CN | 103353254 | A | 10/2013 |
| CN | 203657601 | U | 6/2014 |
| CN | 104048552 | A | 9/2014 |
| CN | 104048553 | A | 9/2014 |
| CN | 203848748 | U | 9/2014 |
| CN | 104154808 | A | 11/2014 |
| CN | 104689934 | A | 6/2015 |
| CN | 104759364 | A | 7/2015 |
| CN | 104864743 | * | 8/2015 |
| CN | 104864743 | A | 8/2015 |
| GB | 620373 | * | 1/1948 |
| JP | H0666494 | A | 3/1994 |
| KR | 101349114 | B1 | 1/2014 |

OTHER PUBLICATIONS

State Intellectual Property Office (PRC), Office Action for CN Application No. 201511003733.1, dated Aug. 2, 2018.

International Searching Authority (SIPO PRC), International Search Report and Written Opinion for International Application No. PCT/CN2016/111305, dated Apr. 5, 2017.

State Intellectual Property Office (PRC), Office Action for CN Application No. 201511005934.5, dated Jul. 3, 2018.

USPTO, Non-Final Office Action for U.S. Appl. No. 16/066,916, dated May 1, 2020.

International Searching Authority (SIPO PRC), International Search Report and Written Opinion for International Application No. PCT/CN2016/111316, dated Mar. 6, 2017.

* cited by examiner

WATER DISTRIBUTION SYSTEM WITH WIDE-RANGE VARIABLE TRAFFIC

This application is a National Phase entry of PCT Application No. PCT/CN2016/111316, filed on Dec. 21, 2016, which claims priority to Chinese Patent Application No. 201511003733.1, titled "WATER DISTRIBUTION SYSTEM HAVING WIDE-RANGE VARIABLE FLOW RATE", filed on Dec. 28, 2015 with the State Intellectual Property Office of the People's Republic of China, which are incorporated herein by reference in their entireties.

FIELD

The present application relates to the technical field of cooling towers, and in particular to a water distribution system having a wide-range variable flow rate.

BACKGROUND

The working principle of a cooling tower is that, flowing air is blown to the sprayed water from a suitable angle, and when the air passes through the water droplets, part of the water evaporates. Since heat is used for evaporating the water and the temperature of the water is reduced, the remaining water is cooled down.

A traditional cooling tower generally has a water distribution system, and a traditional water distribution system requires a standard water volume to maintain a stable operation. With the standard water volume, the water reaches a certain level, and each spray nozzle has a certain water level, and in such a case, the spray nozzles have no large differences in flow rates, and the system can operate stably. If the practical flow rate deviates from the above standard flow rate, for instance, the water volume becomes small (several reasons may cause the water volume to become small, such as, most commonly, imbalance of hydraulic power when several towers operate together, air resisting of pipelines, and empty bottom basin after a suction process), the water flowing from the water distribution tube to the water distribution basin is not sufficient to maintain a stable water level, and there is a large water level difference in the water distribution system from a close outlet to a far outlet. The water outputted from the spray nozzle may change obviously in volume due to the change of the water level, and non-uniform water distribution may occur.

Therefore, an important technical issue to be addressed by the person skilled in the art is to address the issue in the conventional technology that the water distribution system distributes water non-uniformly when the real-time water volume is a non-standard water volume.

SUMMARY

In order to address the technical issue, a water distribution system having a wide-range variable flow rate is provided according to the present application, which is capable of avoiding the issue of non-uniform water spraying when the real-time water pressure is a non-standard water pressure.

A water distribution system having a wide-range variable flow rate according to the present application includes a water distribution sink; and at least two types of spray nozzles uniformly distributed on a bottom of the water distribution sink. Each of the types of spray nozzles is provided with a spray tube connected to the bottom of the water distribution sink, the spray tube is provided with a water inlet at an upper part and a water outlet at a lower part, and heights of the water inlets of the at least two types of spray nozzles protruding from the bottom of the water distribution sink are different.

Preferably, the water inlet arranged at the upper part of the spray tube is larger than the water outlet arranged at the lower part thereof.

Preferably, the spray nozzles at least include a first low-pressure high-diffusion variable-flow rate spray nozzle and a second low-pressure high-diffusion variable-flow rate nozzle, and each of the first low-pressure high-diffusion variable-flow rate spray nozzle and the second low-pressure high-diffusion variable-flow rate spray nozzle includes:

a spiral guiding groove arranged on an inner side wall of the spray tube, specifically, water flowing into the spray tube flows downward in a spiral direction along the spiral guiding groove;

a fluid diverting accelerator connected to a lower side of the spray tube; and a tension eliminator arranged on the fluid diverting accelerator.

Specifically, a water-facing surface of the fluid diverting accelerator has a central portion higher than an edge portion thereof, and the central portion of the water-facing surface is transitioned to the edge portion through a cambered surface to allow the water flow flowing down in a vertical direction to gradually flow horizontally through the cambered surface, the tension eliminator protrudes from the water-facing surface, and the tension eliminator has a first end close to the central portion and a second end close to the edge portion, and the tension eliminator has a thickness gradually increasing from top to bottom and gradually increasing from the central portion to the edge portion of the water-facing surface.

Preferably, the water inlet of the first spray nozzle is higher than the bottom of the water distribution sink by more than 10 mm, and the water inlet of the second spray nozzle is flush with the bottom of the water distribution sink.

Preferably, multiple first spray nozzles and multiple second spray nozzles are uniformly distributed on the bottom of the water distribution sink.

Preferably, multiple tension eliminators are provided, and the tension eliminators are distributed on the water-facing surface in a circumferential direction with the central portion as the center of a circle.

Preferably, any one of the tension eliminators is a triangular cone having a first vertex, a second vertex, a third vertex, and a fourth vertex, and a line connecting any two vertices is an edge of the triangular cone, the first vertex, the second vertex and the third vertex are arranged on the water-facing surface, and the first vertex is close to the central portion, the second vertex and the third vertex are close to the edge portion, and the fourth vertex protrudes from the water-facing surface.

Preferably, the projection of the fourth vertex in the vertical direction is beyond the water-facing surface.

Preferably, a line connecting the first vertex with the second vertex has a length equal to the length of a line connecting the first vertex with the third vertex, and the fourth vertex is located on a symmetry plane of a triangle defined by the first vertex, the second vertex, and the third vertex.

Preferably, a line connecting the fourth vertex with the first vertex is tangent to a water through hole.

Preferably, the line connecting the fourth vertex with the first vertex intersects with a centerline of the water through hole.

Preferably, the central portion of the fluid diverting accelerator is provided with a water through hole which penetrates the central portion in the vertical direction.

Preferably, the water through hole is a taper hole whose diameter gradually increases from top to bottom.

Preferably, the fluid diverting accelerator includes at least two stages of fluid diverting accelerators, and the stages of fluid diverting accelerators are distributed in the vertical direction, and each of the stages of fluid diverting accelerators is provided with a tension eliminator.

Preferably, the fluid diverting accelerator includes multiple stages of fluid diverting accelerators, each of the stages of fluid diverting accelerators is provided with the tension eliminator, and the multiple stages of fluid diverting accelerators are sequentially connected in the vertical direction.

Preferably, two adjacent stages of fluid diverting accelerators are connected by a first connecting post.

Preferably, the spray tube is provided with a flange at a lower part thereof.

Preferably, an uppermost stage of fluid diverting accelerator is connected to the flange by a second connecting post.

Preferably, the flange and the second connecting post are snapped together by a snap joint and a snap groove.

In such an arrangement according to the technical solution of the present application, at least two types of spray nozzles are uniformly distributed on the bottom of the water distribution sink, and the and heights by which the water inlets of the at least two types of spray nozzles protrude from the bottom of the water distribution sink are different. For ease of description, the first spray nozzles and second spray nozzles are taken as examples hereinafter to describe. Specifically, the water inlet of the second spray nozzle is lower than the water inlet of the first spray nozzle. Thus, when the flow rate is less than the standard flow rate, only the second spray nozzles work, and when the flow rate is greater than the standard flow rate, both the first spray nozzles and the second spray nozzles work. Therefore, no matter whether the system is under the standard working condition or not, even if there is only 10% of the flow of the standard working condition, the packing of the system can obtain uniformly distributed water, which enables the cooling tower to work perfectly under various working conditions.

In addition, the inner side wall of the spray tube is provided with the spiral guiding groove which spirally extends downwards from an upper end to a lower end of the spray tube, thus, the water entering the spray tube spirally flows along the spiral guiding groove, generating a vortex effect which increases the centrifugal force of the water, so as to ensure a water dispersing area.

Water falls on the water-facing surface of the fluid diverting accelerator after flowing out of the spray nozzles. Since the water-facing surface is a tapered surface which gradually expands from top to bottom, the water flow flowing down in the vertical direction is diverted to gradually flow horizontally through the tapered surface, which further ensures the diffusion area of the water.

Moreover, the water may become tangent to the tension eliminators in the diverting process. Since the thickness of the tension eliminator gradually increases from top to bottom, and also gradually increases from the central portion to the edge portion of the water-facing surface, therefore, the water flow can be gradually divided by the tension eliminator when flowing on the water-facing surface, and the resistance encountered by the water flow is small. Since the water flow is divided by the tension eliminator, the water flow is prevented from being biased towards the same direction due to a tension concentration thereof. Therefore, the spray nozzles according to the present application can spray water flows farther and more uniformly under any working conditions.

REFERENCE NUMERALS IN FIGS. 1 TO 7

| | | | |
|---|---|---|---|
| 11 | fluid diverting accelerator, | 12 | tension eliminator, |
| 13 | water-facing surface, | 14 | central portion, |
| 15 | edge portion, | 16 | water through hole, |
| 17 | first vertex, | 18 | second vertex, |
| 19 | third vertex, | 20 | fourth vertex, |
| 21 | spray tube, | 22 | spiral guiding groove, |
| 23 | first connecting post, | 24 | second connecting post, |
| 25 | flange, | 27 | water distribution sink, |
| 28 | first spray nozzle, | 29 | second spray nozzle. |

DETAILED DESCRIPTION OF EMBODIMENTS

A water distribution system having a wide-range variable flow is provided according to this embodiment, which can avoid non-uniform water spraying when a real-time water pressure is a non-standard water pressure.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of protection of the present application.

Figure 1:
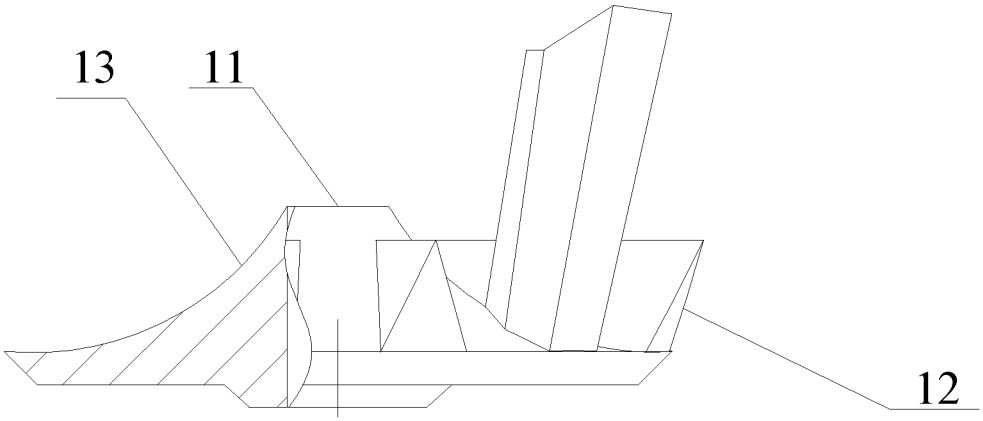
FIG. 1 is a partial sectional view of a fluid diverting accelerator and a tension eliminator according to an embodiment of the present application.
Figure 2:
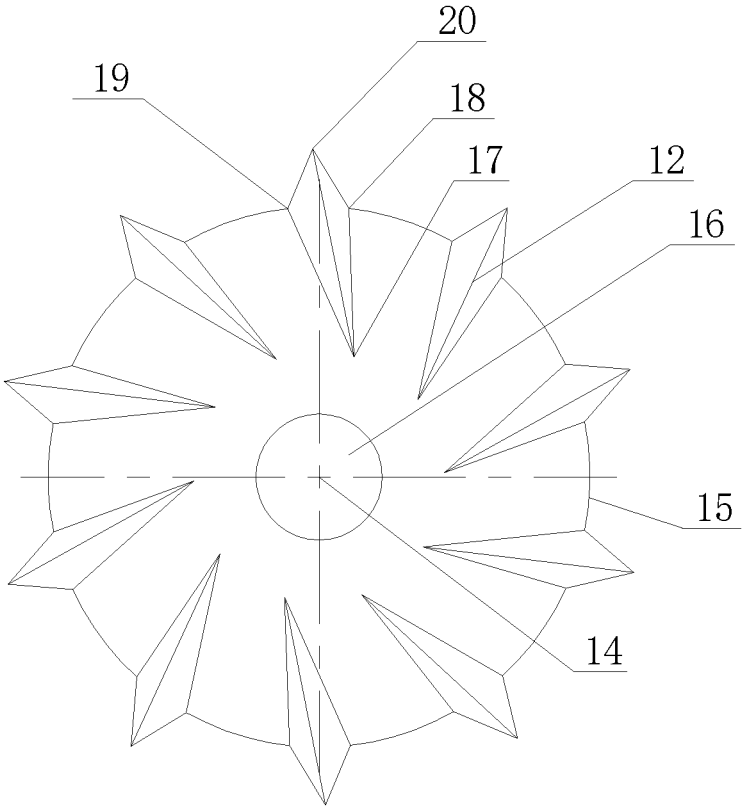
FIG. 2 is a top view of a fluid diverting accelerator and a tension eliminator according to an embodiment of the present application.
Figure 3:
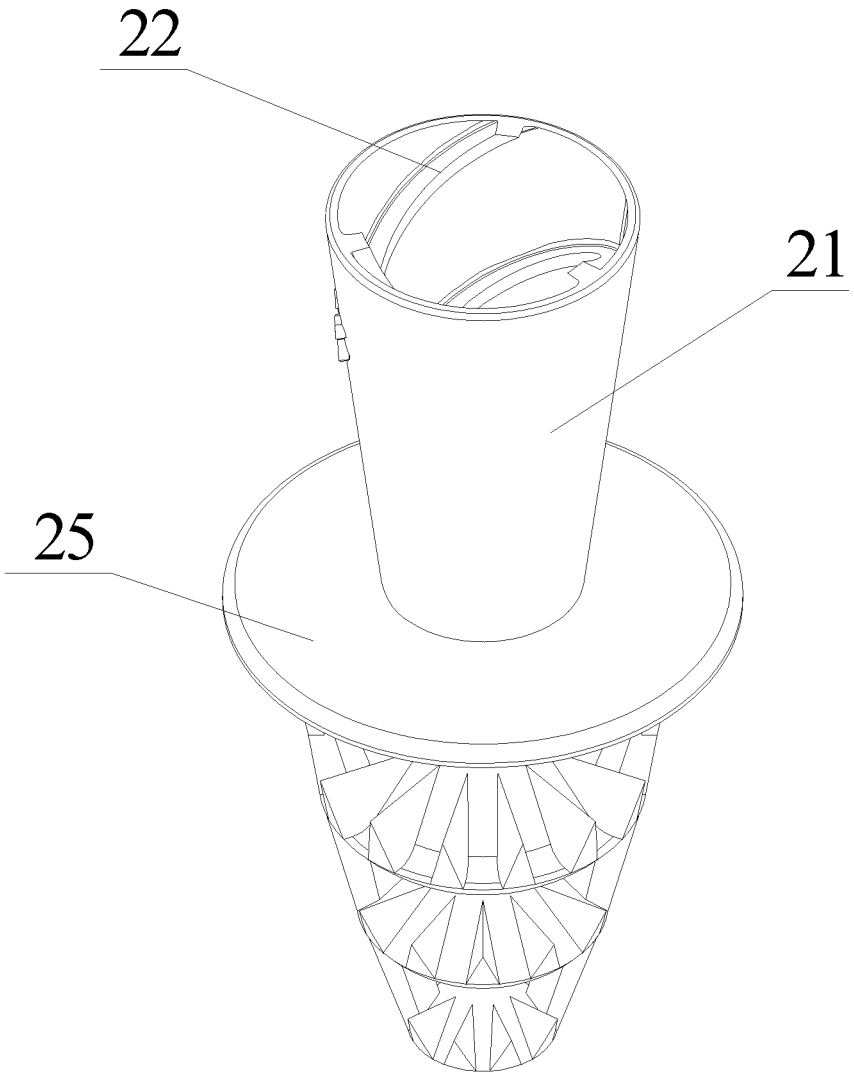
FIG. 3 is a schematic view of a spray nozzle with three stages of fluid diverting accelerators according to an embodiment of the present application.
Figure 4:
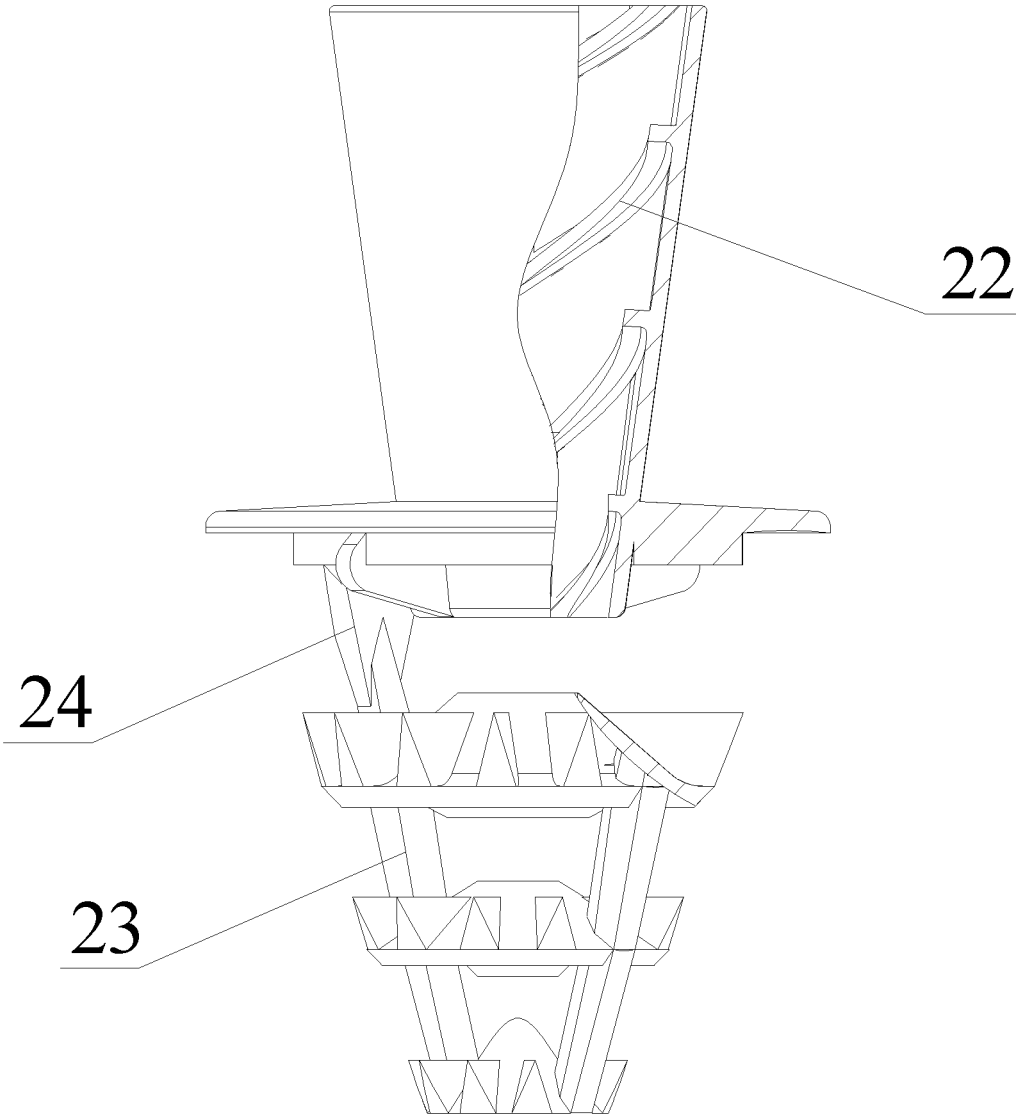
FIG. 4 is a partial sectional view of a spray nozzle with three stages of fluid diverting accelerators according to an embodiment of the present application.
Figure 5:
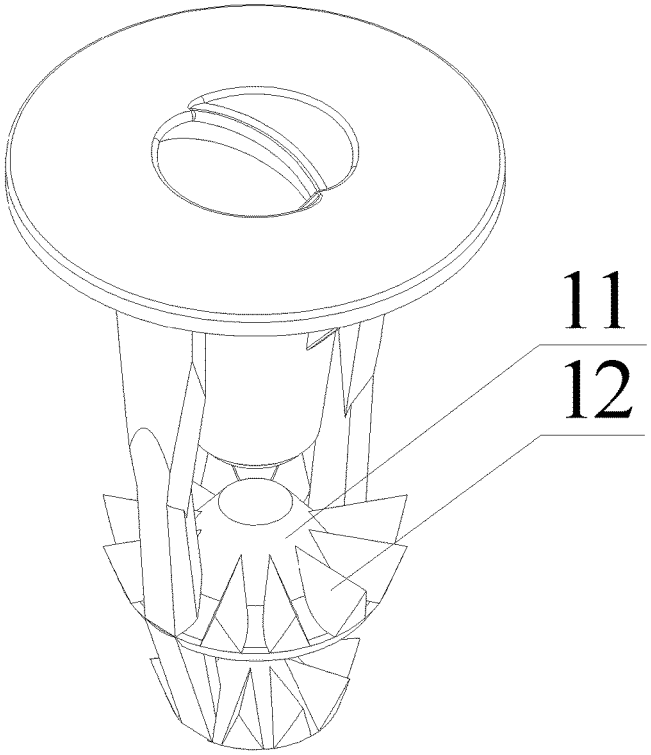
FIG. 5 is a schematic view of a spray nozzle with two stages of fluid diverting accelerators according to an embodiment of the present application.
Figure 6:
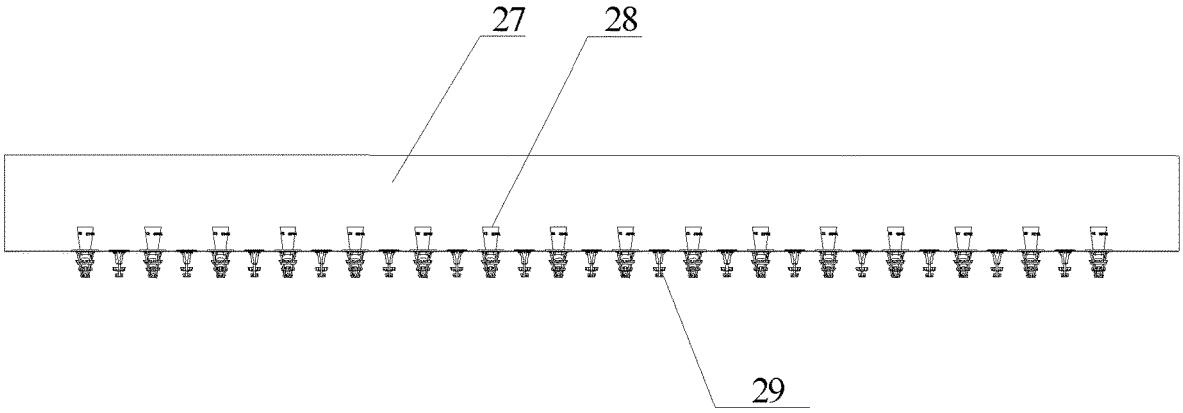
FIG. 6 is a schematic front view of a wide-range variable flow rate water distribution system according to an embodiment of the present application.
Figure 7:
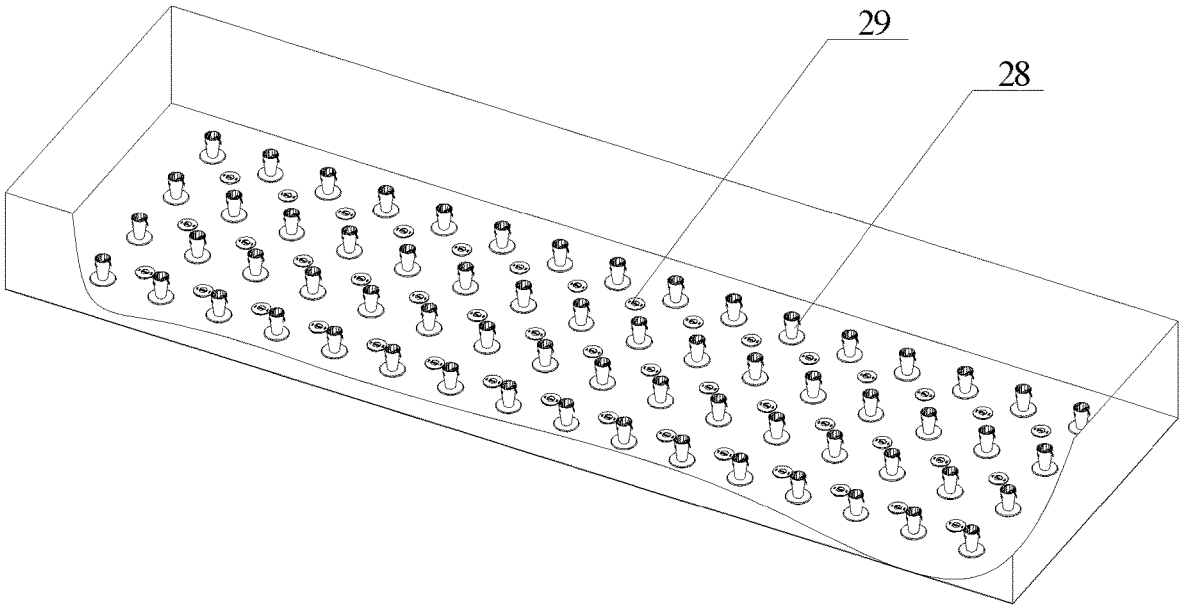
FIG. 7 is a schematic top view of a wide-range variable flow rate water distribution system according to an embodiment of the present application.

Referring to FIGS. 1 to 7, a water distribution system having a wide-range variable flow according to this embodiment includes a water distribution sink 27, multiple first spray nozzles and multiple second spray nozzles distributed at a bottom of the water distribution sink 27. Of course, it may further include multiple third nozzles and multiple fourth nozzles. For ease of description, the multiple first spray nozzles and the multiple second spray nozzles are taken as an example hereinafter to describe.

Preferably, multiple spray nozzles of different heights are arranged on the water distribution sink according to a certain rule, so as to increase or decrease the water volume in a target region in a water distribution system, thereby achieving a function of melting ice in winter.

Each of a first spray nozzle 28 and a second spray nozzle 29 includes a spray tube 21, a fluid diverting accelerator 11 connected to a lower side of the spray nozzle, and a tension eliminator 12 arranged on the fluid diverting accelerator 11.

In this embodiment, a water inlet of the spray tube of the first spray nozzle 28 is higher than a water inlet of the spray tube 21 of the second spray nozzle 29, and the water inlet of the first spray nozzle 28 is larger than the water inlet of the second spray nozzle 29, that is, the flow rate of the first spray nozzle 28 is greater than the flow rate of the second spray nozzle 29. It should be noted that, in this embodiment, common nozzles of other types may also be applied as long as they can ensure that the water inlet of the spray tube of the first spray nozzle is higher and larger than the water inlet of the spray tube of the second spray nozzle, The spray tube 21 is provided with a water inlet at an upper part and a water outlet at a bottom part, an inner side wall of the spray tube 21 is provided with a spiral guiding groove 22, and water flowing into the spray tube flows downward in a spiral direction along the spiral guiding groove 22.

A water-facing surface 13 of the fluid diverting accelerator 11 has a central portion 14 higher than an edge portion 15, and the central portion 14 of the water-facing surface 13 is transitioned through a cambered surface to the edge portion 15, so as to allow the water flowing in a vertical direction to gradually flow horizontally through the cambered surface.

It should be noted that the above water-facing surface 13 is a cambered surface capable of gradually diverting a water flowing direction from vertical to horizontal. Specifically, the cambered surface can be arranged as follows: in any one of vertical sections of the fluid diverting accelerator 11, the central portion 14 of the water-facing surface 13 is transitioned along a curved line toward the edge portion 15, and a midpoint of a line connecting two ends of the curved line is higher than a midpoint of the curved line. The water-facing surface 13 of such a structure can gradually change the direction of the water from vertical to horizontal. Of course, the cambered surface may also have a structure similar to an outer peripheral curved surface of a cone.

The tension eliminator 12 protrudes from the water-facing surface 13. The tension eliminator 12 has a first end close to the central portion 14 and a second end close to the edge portion 15, the tension eliminator 12 has a thickness gradually increasing from top to bottom and also gradually increasing from the central portion 14 to the edge portion 15 of the water-facing surface 13. When water flows from top to bottom and from the central portion 14 to the edge portion 15, the tension eliminator 12 can gradually divide the water flow into two parts, and allow the water flow to encounter less resistance, thus energy consumption in flow division is reduced.

In addition, in this embodiment, a central portion of the fluid diverting accelerator 11 may be provided with a water through hole, which penetrates the central portion in a vertical direction. It should be noted that the water through hole 16 in the central portion of the fluid diverting accelerator 11 may have an increased diameter, a decreased diameter or even be canceled according to application requirements. Providing the water through hole 16 in the fluid diverting accelerator 11 may prevent water from forming a hollow circle after being sprayed. Moreover, in this embodiment, the fluid diverting accelerator 11 may be arranged into two stages which are distributed in the vertical direction, and each of the stages of the fluid diverting accelerator 11 is provided with a tension eliminator. Of course, the number of stage of the fluid diverting accelerator 11 may also be one, or three, or four etc., which may be set according to specific conditions, and will not be specifically described herein.

With such an arrangement, in the technical solution according to this embodiment, nozzles with differently sized inlets, that is, nozzles with different flow rates, are combined to use, thus, when the flow rate is less than the standard flow rate, only the second spray nozzle 29 with small a water inlet works, and when the flow rate is greater than the standard flow rate, both the first spray nozzle 28 with a large water inlet and the second spray nozzle work. Therefore, no matter whether the system is under the standard working condition or not, even if there is only 10% of the flow of the standard working condition, the system can obtain uniformly distributed water, which enables the cooling tower to work perfectly under various working conditions.

Water in the water distribution sink 27 enters the spray tube 21 through the water inlet of the spray tube 21 of the first spray nozzle 28 and/or the second spray nozzle 29, and since the inner side wall of the spray tube 21 is provided with the spiral guiding groove 22 which spirally extends downwards from an upper end to a lower end of the spray tube, the water entering the spray tube 21 spirally flows along the spiral guiding groove 22, generating a vortex which increases the centrifugal force of the water flow, so as to ensure a water dispersing area.

When the water flows out of the spray tube 21 and then falls on the water-facing surface 13 of the fluid diverting accelerator, the water flow first comes into contact with the central portion 14 and flows along the water-facing surface 13 toward the edge portion 15 of the water-facing surface 13 since the central portion 14 of the water-facing surface 13 is higher than the peripheral edge portion 15. Since the water-facing surface 13 is a cambered surface capable of gradually changing the direction of the water flow from vertical to horizontal, the water flow can flow along the cambered surface gradually from vertically to horizontally, such that the water can be sprayed farther. Also, the water may become tangent to the tension eliminator 12 in the diverting process, and since the thickness of the tension eliminator 12 gradually increases from top to bottom, and also gradually increases from the central portion 14 to the edge portion 15 of the water-facing surface 13, the water flow can be gradually divided by the tension eliminator 12 when flowing on the water-facing surface 13. Moreover, the resistance encountered by the water flow is small and the water flow is divided by the tension eliminator 12, thereby preventing the water flow from concentratedly flowing in one direction. Therefore, the first spray nozzle and the second spray nozzle according to the present application can spray water flows farther and more uniformly under any working conditions.

It should be noted that, the heights of the inlets of the first spray nozzle and second spray nozzle may be set according to specific conditions, for instance, the water inlet of the first spray nozzle may be higher than the bottom of the water distribution sink by more than 10 mm, and the water inlet of the second spray nozzle may be flush with the bottom of the water distribution sink.

In addition, in a preferred solution of this embodiment, multiple first spray nozzles 28 and second spray nozzles 29 are uniformly distributed on the bottom of the sink. For example, the multiple first spray nozzles and second spray nozzles may be distributed in a plum blossom shape on the bottom of the water distribution sink, and are respectively grouped without interfering with each other, and the quantities and arranging concentration of the first spray nozzles and second spray nozzles may be adjusted respectively according to the specific requirements of a user. Alternatively, the multiple first spray nozzles 28 may be distributed in a matrix shape, and the multiple second spray nozzles 29 may also be distributed in a matrix shape, such that the distribution of the sprayed water is more uniform. In addition, when being used in frigid regions, the spray nozzle with a large diameter and a low water inlet may be concentratedly arranged as tubes for melting ice.

Further, multiple tension eliminators 12 are provided and are distributed on the water-facing surface 13 in a circumferential direction with the central portion 14 as the center of a circle.

With such an arrangement, the water flow on the water-facing surface 13 can be divided into multiple water flows, and the connection between the water flows is cut off, such that the water flow can be distributed more uniformly.

In a preferred solution of this embodiment, the above tension eliminator 12 is a triangular cone with a first vertex 17, a second vertex 18, a third vertex 19 and a fourth vertex 20. A line connecting any two vertices is an edge of the triangular cone.

Specifically, the first vertex 17, the second vertex 18 and the third vertex 19 are arranged on the water-facing surface 13, the first vertex 17 is close to the central portion 14, the second vertex 18 and the third vertex 19 are close to the edge portion 15, and the fourth vertex 20 protrudes from the water-facing surface 13.

With such an arrangement, the triangular conical shaped tension eliminator 12 is capable of dividing the water flow obviously while causing less resistance to the water flow.

Moreover, a projection of the fourth vertex 20 in the vertical direction is beyond the water-facing surface 13, that is, the projection of the fourth vertex 20 in the vertical direction is outside a plane surrounded by the edge portion 15, that is, the fourth vertex protrudes outside a cylinder where the water-facing surface is located. With such an arrangement, the separated water flows can be prevented from recombining under tension, thereby further improving the flow division.

In order to divide the flow uniformly, a line connecting the first vertex 17 with the second vertex 18 has a length equal to the length of a line connecting the first vertex 17 with the third vertex 19, that is, the triangle defined by the first vertex 17, the second vertex 18 and the third vertex 19 is an isosceles triangle. The fourth vertex 20 is located on a symmetry plane of the isosceles triangle, arranged as such, the edge formed by the first vertex 17 and the fourth vertex 20 is on a symmetry plane of the tension eliminator 12, and the edge can equally divide the water flow into two flows.

It should be noted that, in this embodiment, the line connecting the fourth vertex 20 and the first vertex 17 is tangent to the water through hole 16 or intersects with the center line of the water through hole 16. This arrangement allows an extension direction of the tension eliminator 12 to substantially coincide with the flowing direction of the water flow, and can further reduce the resistance induced by the tension eliminator 12 to the water flow.

In this embodiment, in the case that the fluid diverting accelerator includes multiple stages of fluid diverting accelerators, for ease of connection, two adjacent stages of the fluid diverting accelerators may be connected by a first connecting post 23, and all the fluid diverting accelerators and the first connecting post 23 are connected into an integrated structure by injection molding. In this way, it is convenient to connect the stages of the fluid diverting accelerators together.

In order to conveniently connect the spray tube 21 to the fluid diverting accelerator 11 at the lower side of the spray tube, a flange 25 may be provided at a lower part of the spray tube 21, and the flange 25 and the spray tube 21 may be connected into an integrated structure by injection molding. The uppermost stage of the fluid diverting accelerator 11 is connected to the flange 25 by a second connecting post 24. Specifically, the flange 25 may be provided with a snap joint protrusion, and the second connecting post 24 may be provided with a snap groove. It is convenient to connect the flange and the second connecting post together by snap.

In a preferred solution of this embodiment, the spray tube 21 has an inner diameter gradually decreased from top to bottom. With such an arrangement, the sprayed water flow has sufficient water pressure to be sprayed on the fluid diverting accelerator 11, thereby achieving a better diffusion effect.

The wide-range variable flow rate water distribution system according to the present application is described in detail hereinbefore. The principle and the embodiments of the present application are illustrated herein by specific examples. The above description of examples is only intended to help the understanding of the method and concept of the present application. It should be noted that, for the person skilled in the art, a few of modifications and improvements may be made to the present application without departing from the principle of the present application, and these modifications and improvements are also deemed to fall into the scope of protection of the present application defined by the claims.

The invention claimed is:

1. A water distribution system having a wide-range variable flow rate, comprising:

a water distribution sink; and at least two types of spray nozzles uniformly distributed on a bottom of the water distribution sink, wherein each of the types of spray nozzles is provided with a spray tube connected to the bottom of the water distribution sink, the spray tube is provided with a water inlet at an upper part and a water outlet at a lower part, and heights of the water inlets of the at least two types of spray nozzles protruding from the bottom of the water distribution sink are different; and wherein the at least two types of spray nozzles comprise a first low-pressure high-diffusion variable-flow rate spray nozzle and a second low-pressure high-diffusion variable-flow rate spray nozzle, and each of the first low-pressure high-diffusion variable-flow rate spray nozzle and the second low-pressure high-diffusion variable-flow rate spray nozzle comprises:

a spiral guiding groove arranged on an inner side wall of the spray tube, wherein water flowing into the spray tube flows downward in a spiral direction along the spiral guiding groove, a fluid diverting accelerator connected to a lower side of the spray tube, and a tension eliminator arranged on the fluid diverting accelerator, wherein a water-facing surface of the fluid diverting accelerator has a central portion and an edge portion, and the central portion is higher than the edge portion, and the central portion of the water-facing surface is transitioned to the edge portion through a cambered surface to allow the water flow flowing down in a vertical direction to gradually flow horizontally through the cambered surface, the tension eliminator protrudes from the water-facing surface, and the tension eliminator has a first end close to the central portion and a second end close to the edge portion, and the tension eliminator has a thickness gradually increasing from top to bottom and gradually increasing from the central portion to the edge portion of the water-facing surface.

2. The water distribution system having the wide-range variable flow rate according to claim 1, wherein the water inlet arranged at the upper part of the spray tube is larger than the water outlet arranged at the lower part thereof.

3. The water distribution system having the wide-range variable flow rate according to claim 1, wherein the water inlet of the first low-pressure high-diffusion variable-flow rate spray nozzle is higher than the bottom of the water distribution sink by more than 10 mm, and the water inlet of the second low-pressure high-diffusion variable-flow rate spray nozzle is flush with the bottom of the water distribution sink.

4. The water distribution system having the wide-range variable flow rate according to claim 1, wherein a plurality of first low-pressure high-diffusion variable-flow rate spray nozzles and a plurality of second low-pressure high-diffusion variable-flow rate spray nozzles are uniformly distributed in a plum blossom shape on the bottom of the water distribution sink.

5. The water distribution system having the wide-range variable flow rate according to claim 1, wherein a plurality of tension eliminators is provided on the fluid diverting accelerator, and the plurality of tension eliminators are distributed on the water-facing surface in a circumferential direction with the central portion as the center of a circle.

6. The water distribution system having the wide-range variable flow rate according to claim 5, wherein each of the tension eliminators is a triangular cone having a first vertex, a second vertex, a third vertex and a fourth vertex, and a line connecting any two vertices is an edge of the triangular cone, the first vertex, the second vertex and the third vertex are arranged on the water-facing surface, and the first vertex is close to the central portion, the second vertex and the third vertex are close to the edge portion, and the fourth vertex protrudes from the water-facing surface.

7. The water distribution system having the wide-range variable flow rate according to claim 5, wherein each of the plurality of tension eliminators is a triangular cone having a first vertex, a second vertex, a third vertex and a fourth vertex, and a line connecting any two vertices is an edge of the triangular cone, the first vertex, the second vertex and the third vertex are arranged on the water-facing surface, and the first vertex is close to the central portion, the second vertex and the third vertex are close to the edge portion, and the fourth vertex protrudes from the water-facing surface.

8. The water distribution system having the wide-range variable flow rate according to claim 7, wherein a projection of the fourth vertex in the vertical direction is beyond the water-facing surface.

9. The water distribution system having the wide-range variable flow rate according to claim 8, wherein a line connecting the first vertex with the second vertex has a length equal to the length of a line connecting the first vertex with the third vertex, and the fourth vertex is located on a symmetry plane of a triangle defined by the first vertex, the second vertex, and the third vertex.

10. The water distribution system having the wide-range variable flow rate according to claim 9, wherein a line connecting the fourth vertex with the first vertex is tangent to a water through hole.

11. The water distribution system having the wide-range variable flow rate according to claim 9, wherein the line connecting the fourth vertex with the first vertex intersects with a centerline of the water through hole.

12. The water distribution system having the wide-range variable flow rate according to claim 1, wherein the central portion of the fluid diverting accelerator is provided with a water through hole which penetrates the central portion in the vertical direction.

13. The water distribution system having the wide-range variable flow rate according to claim 12, wherein the water through hole is a taper hole whose diameter gradually increases from top to bottom.

14. The water distribution system having the wide-range variable flow rate according to claim 1, wherein the fluid diverting accelerator at least comprises two stages of fluid diverting accelerators, and the stages of fluid diverting accelerators are distributed in the vertical direction, and each of the stages of fluid diverting accelerators is provided with the tension eliminator.

15. The water distribution system having the wide-range variable flow rate according to claim 1, wherein the fluid diverting accelerator comprises a plurality of stages of fluid diverting accelerators, each of the stages of fluid diverting accelerators is provided with the tension eliminator, and the plurality of stages of fluid diverting accelerators are sequentially connected in the vertical direction.

16. The water distribution system having the wide-range variable flow rate according to claim 15, wherein two adjacent stages of fluid diverting accelerators are connected by a first connecting post.

17. The water distribution system having the wide-range variable flow rate according to claim 16, wherein a lower part of the spray tube is provided with a flange and an uppermost stage of fluid diverting accelerator is connected to the flange by a second connecting post.

18. The water distribution system having the wide-range variable flow rate according to claim 17, wherein the flange and the second connecting post are snapped together by a snap joint and a snap groove.

* * * * *